US008448273B2

(12) United States Patent
Walker et al.

(10) Patent No.: US 8,448,273 B2
(45) Date of Patent: May 28, 2013

(54) PILLOW AND COVER FOR A PILLOW

(75) Inventors: Harry Walker, Montreal (CA); Yair Altman, Montreal (CA)

(73) Assignee: Smartsilk Corporation Inc., Montreal, QC (CA)

( * ) Notice: Subject to any disclaimer, the term of this patent is extended or adjusted under 35 U.S.C. 154(b) by 0 days.

(21) Appl. No.: 12/608,757

(22) Filed: Oct. 29, 2009

(65) Prior Publication Data

US 2010/0139002 A1 Jun. 10, 2010

Related U.S. Application Data

(60) Provisional application No. 61/109,212, filed on Oct. 29, 2008.

(51) Int. Cl.
*A47G 9/10* (2006.01)

(52) U.S. Cl.
USPC ..... 5/636; 5/490; 5/413 R; 5/491

(58) Field of Classification Search
USPC ..... 5/490, 413 R, 636, 491
See application file for complete search history.

(56) References Cited

U.S. PATENT DOCUMENTS

| | | | | |
|---|---|---|---|---|
| 2,371,276 | A * | 3/1945 | Adams | 5/655.8 |
| 3,863,283 | A * | 2/1975 | Mohr | 5/639 |
| 4,656,681 | A | 4/1987 | Alexander et al. | |
| 6,910,237 | B2 * | 6/2005 | DiGirolamo | 5/636 |
| 7,467,432 | B2 * | 12/2008 | Brogan | 5/636 |
| 7,562,405 | B2 * | 7/2009 | Brogan | 5/645 |
| 2003/0172458 | A1 * | 9/2003 | Bonfanti et al. | 5/490 |
| 2006/0112487 | A1 * | 6/2006 | Taylor | 5/490 |
| 2007/0245493 | A1 | 10/2007 | Leifermann et al. | |

FOREIGN PATENT DOCUMENTS

| | | | |
|---|---|---|---|
| DE | 20 2004 006 754 | U1 | 7/2004 |
| EP | 1 576 908 | A2 | 9/2005 |
| GB | 454452 | | 10/1936 |
| JP | 10-155623 | | 6/1998 |
| WO | WO 03/030669 | A1 | 4/2003 |
| WO | WO 2006/009974 | A1 | 1/2006 |

OTHER PUBLICATIONS

Tempur-Pedic, *The GrandBed by Tempur-Pedic—The Healthy Back Store*, Last consulted Oct. 14, 2009, www.healthyback.com/products/tempur-pedic/grandbed-by-tempur-pedic/113.
Green Sleep, *Mattress Pillow, Green Sleep Organic Mattress*, Last consulted Oct. 14, 2009, www.mattress-pillow.com/green-sleep-organic-mattress/.
Silksation, *Silk duvets from quality silk filled duvets from Silk Sation*, Last consulted Oct. 14, 2009, www.silksation.com/bliss_silk_comforter.html.

* cited by examiner

*Primary Examiner* — William Kelleher
(74) *Attorney, Agent, or Firm* — McDermott Will & Emery LLP

(57) ABSTRACT

A cover for a pillow including a hollow body for receiving the pillow, an opening for allowing insertion of the pillow into the hollow body, and a closure spanning the opening for closing the pillow within the hollow body. The hollow body includes a breathable inner liner made of a non-woven material, a breathable outer shell surrounding the inner liner, and a silk floss lining retained between the inner liner and the outer shell. A pillow including the inner liner, outer shell and silk floss lining.

14 Claims, 4 Drawing Sheets

PILLOW AND COVER FOR A PILLOW

FIELD OF THE INVENTION

The present invention relates to bedding and the like. More particularly, and in its preferred intended use, the present invention relates to a pillow and a cover for a pillow.

BACKGROUND OF THE INVENTION

Pillows, as well as covers for pillows, and the like are very well known in the art.

Indeed, a conventional pillow typically comprises a soft, pliable core surrounded by a layer of fabric. A conventional cover typically consists of a removable fabric envelope shaped and sized so as to fit around a pillow. Such simple fabric covers are often referred to as pillow cases or pillow slips and typically comprise a pair of fabric sheets joined along three of their four sides.

It is also known to provide a more substantial cover for a pillow comprised not just of fabric sheets but also of one or more layers of lining, padding, stuffing, wadding or the like. Pillow protectors can provide an extra washable layer between the user and the pillow itself in order to absorb body excretions, such as sweat, or other potentially staining fluids and which could otherwise stain the pillow. It is known to go so far as to provide pillow protectors with a polyester lining, or some other non-breathable, waterproof lining.

A pillow protector may be used in place of, or in combination with, a conventional pillow case.

It is known that that allergens and irritants such as dust mites, bed bugs, mold and dead skin may build up on and/or within a pillow. Dead skin and pet dander, which may be deposited on a pillow or pillow cover, may penetrate the pillow, thereby providing food for dust mites. Individuals who are susceptible to certain types of allergies, especially dust mites, may develop allergic reactions, asthma, and skin irritation such as eczema.

Previous attempts to prevent transmission of allergens and irritants include providing a polyurethane lining and chemically-treating the protector. It will be appreciated that these techniques have several known drawbacks.

PCT patent application no. WO 2006/009974 (Rawls-Meehan) describes a pillow having an air flow device which can selectively control air flow into and out of the pillow. The pillow includes a foam core surrounded by an inner layer of a non-woven, non-breathable fabric, a layer of soft material and a cotton outer layer.

German patent application no. DE 20 2004 006 745 (Friedrich) describes a material composition for bedding, pillows and mattresses comprising layers of silk, layers of horsehair or mixed layers of both silk and horsehair. Friedrich also describes layers of woven cotton fleece disposed between these layers.

Also known in the art are the following patents and published patent applications: GB 454,452, U.S. Pat. No. 4,656,681, US 2007/0245493, JP 10-155623, WO 2003/030669, EP 1 576 908.

Hence, in light of the afore-mentioned, there remains a need for an improved cover for a pillow which, by virtue of its design and components, satisfies some of the needs which are known in the art and is thus an improvement over other related known covers.

SUMMARY OF THE INVENTION

An aspect of the present invention is to provide a cover for a pillow which, by virtue of its design and components, satisfies at least some of the above-mentioned needs and is thus an improvement over other related devices known in the prior art.

Indeed, according to a preferred embodiment of the present invention, there is provided a cover for a pillow including a hollow body for receiving the pillow, an opening for allowing insertion of the pillow into the hollow body, and a closure spanning the opening for closing the pillow within the hollow body. The hollow body includes a breathable inner liner made of a non-woven material, a breathable outer shell surrounding the inner liner, and a silk floss lining retained between the inner liner and the outer shell.

According to another preferred embodiment of the present invention, there is provided a pillow including a core, a breathable inner liner, the inner liner being composed of a non-woven material, a breathable outer shell surrounding the inner liner and the core, and a silk floss lining retained between the inner liner and the outer shell.

Preferably, the silk floss lining has a weight greater than about 60 grams per square meter (gsm), the outer shell is a woven cotton material and the inner liner has a weight of at least about 55 gsm. More preferably, the silk floss lining has a weight of at least about 80 gsm. Even more preferably, the silk floss lining has a weight between about 85 gsm and about 130 gsm, inclusively. Most preferably, the silk floss lining has a weight of about 85 gsm.

BRIEF DESCRIPTION OF THE DRAWINGS

The invention will be better understood upon reading the following non-restrictive description of the preferred embodiment thereof, made with reference to the accompanying drawings in which.

DETAILED DESCRIPTION OF PREFERRED EMBODIMENT OF THE INVENTION

In the following description, the same numerical references refer to similar elements. The embodiment shown in the figures is preferred, for exemplification purposes only.

In the context of the present description, the expression "pillow" includes various types of bedding as apparent to a person skilled in the art. For this reason, the expressions "cover", "protector", "slip" or "case" for example, should not be taken as to limit the scope of the present invention and includes other usages or items with which the present invention may be used and could be useful.

In addition, although the preferred embodiment of the present invention as illustrated in the accompanying drawings comprise various components, etc., and although the preferred embodiment of the cover and corresponding parts of the present invention as shown consist of certain geometrical configurations as explained and illustrated herein, not all of these components and geometries are essential to the invention and thus should not be taken in their restrictive sense, i.e. should not be taken as to limit the scope of the present invention. It is to be understood, as also apparent to a person skilled in the art, that other suitable components and cooperations therebetween, as well as other suitable geometrical configurations may be used for a cover according to the present invention, as will be briefly explained herein and as can be easily inferred herefrom by a person skilled in the art, without departing from the scope of the invention.

Figure 1:
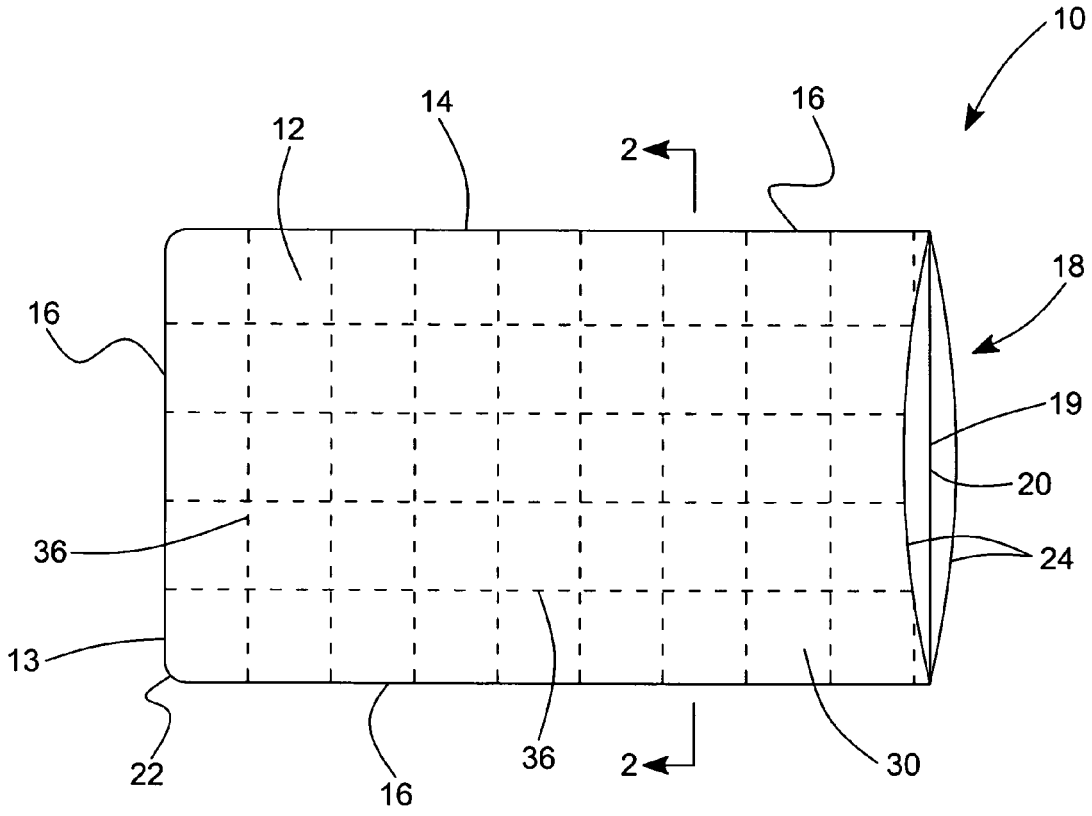
FIG. 1 is a top view of a cover in accordance with a preferred embodiment of the present invention.

With reference to FIG. 1, a cover 10 for a pillow 11 (see FIG. 2) is illustrated which comprises a hollow body 13 formed by first and second panels 12 and 14 which are joined along three sides 16. The fourth side 18 comprises an opening 19 which preferably spans a majority of the fourth side and which is openable and closable by a closure 20. Preferably, a zipper 20 is provided although other forms of closing mechanisms and/or systems may also be used.

The first and second panels 12 and 14 are preferably sewn together along the three sides 16 and finished along the outside by cotton piping 22, which strengthens the seam and prevents the lining (discussed in further detail below) from escaping therethrough.

Preferably, the zipper 20 is not provided along the exterior edge of the cover 10, but rather slightly inside of the fourth side 18, in order to prevent the user from coming into contact therewith during use. A pair of flaps 24 extends on either side of the zipper 20 to the fourth side 18, thereby concealing the zipper 20 when flattened. The flaps 24 are approximately one inch wide. Preferably, the zipper 20 is an "invisible zipper" which, as is known in the art, is provided with overlapping flanges adjacent each zipper half and which cover the zipper and zipper pull when closed, thereby concealing the zipper behind a seam-like joint. In addition, this type of zipper provides a stronger durable closing means 20 which is less likely to deform during washing.

With additional reference now to FIG. 2, which illustrates the cover 10 in cross-section with a portion thereof removed for clarity, and FIG. 3, which shows the panel 12 from within the cover 10, the construction of the panels 12 and 14 will be discussed in more detail.

Both panels 12 and 14 comprise an outer layer 30, also called the outer shell 30, an inner layer 32, also called the inner liner 32, and a silk floss lining 34 which is disposed therebetween. All three layers 30, 32 and 34 are breathable, i.e. they permit the flow of air to flow therethrough.

The outer shell 30 is preferably a woven cotton material, and more preferably 100% cotton 233 count, although may be chosen from a variety of breathable cotton or poly-cotton blends. The inner liner 32 is a non-woven material, preferably made of polypropylene and having a weight equal or greater than about 40 grams per square meter (gsm). More preferably, the inner liner has a weight of at least 55 gsm.

The lining 34 is made of silk fill floss, preferably a naturally processed silk floss. It has been found that silk floss having a weight of greater than 60 gsm provides an advantageous combination of properties. More preferably, the silk floss lining 34 has a weight of at least about 80 gsm. A silk floss lining 34 having a weight of about 85 gsm has been determined as having a highly preferable combination of properties, including structural integrity, wicking and protection from irritants/allergens. A silk floss lining 34 having greater than 85 gsm may also have an advantageous combination of these properties, but will have the disadvantage of increased cost. One advantageous but economical embodiment would be a cover 10 having a silk floss lining 34 with a weight of at least about 85 gsm and less than about 130 gsm, inclusively.

It will be appreciated by one of ordinary skill in the art that the "weight" of the various layers discussed above, as measured in grams per square meter, is often referred to as the "basic weight" or the "density", of the given fabric or material. Moreover, it will also be appreciated that in practice the above-mentioned weights can rarely be specified exactly, but rather will often vary by 5%-10% for a given sample of the material.

In addition to providing a breathable wicking layer, the silk lining 34 is provided to block allergens and irritants which might be present on or within the pillow. Moreover, silk is a natural product to which mites are adverse, and is therefore may therefore prevent irritation. Silk floss advantageously provides fire retardant properties. Furthermore, the silk core 34 draws sweat away from the outer layer, i.e. that which is in contact with the user's skin. This ability to draw away moisture, known as wicking, aids in keeping the user cool during their sleep. This is especially beneficial for users such as menopausal women who are prone to sweat a greater than average amount during the night.

Preferably, the layers 30, 32 and 34 of each panel 12 and 14 are quilted, that is to say they are connected to one another by a plurality of stitches 36 which extend longitudinally and transversely across and through each panel 12 and 14. The quilting preferably takes the form of a linear grid. A grid of 4¼ inch by 4¼ inch squares is preferred, although it will be appreciated that various other quilting patterns could similarly be used, including linear grids formed of rectangles or lozenges, or indeed a square grid of different dimensions. It has been determined that this 4¼ inch grid size advantageously ensures the stability of the silk floss lining 34 while maintaining maximizing the comfort provided by the lining material. Of course, the stitching could form various patterns of various sizes without departing from the scope of the present invention.

It has also been determined that the preferred embodiment detailed above advantageously provides a cover 10 with a lining 34 which maintains its integrity of wicking away perspiration and protects users from irritants and allergens over a minimum of 25 washes, while remaining cost effective to manufacture and market. It has also been determined that the preferred embodiment advantageously provides a cover 10 with an inner liner 32 which protects the pillow from bodily fluids while being light and soft enough not to be noticeable by a user, while being able to retain its integrity and not pill (i.e. form protruding fibers) and disintegrate when washed.

It will be appreciated that the closing means 20 of the present invention is important in order to fully encase the pillow and prevent the transmission of allergens and irritants from the pillow to the user. A cover which is not fully closable, even if it is closed by buttons for example, would permit allergens and irritants held within the pillow from escaping and could therefore not be considered "asthma & allergy friendly". Similarly, it will be appreciated that the silk lining 34 must fully surround the pillow in order to truly protect the user from allergens and irritants.

Figure 2:
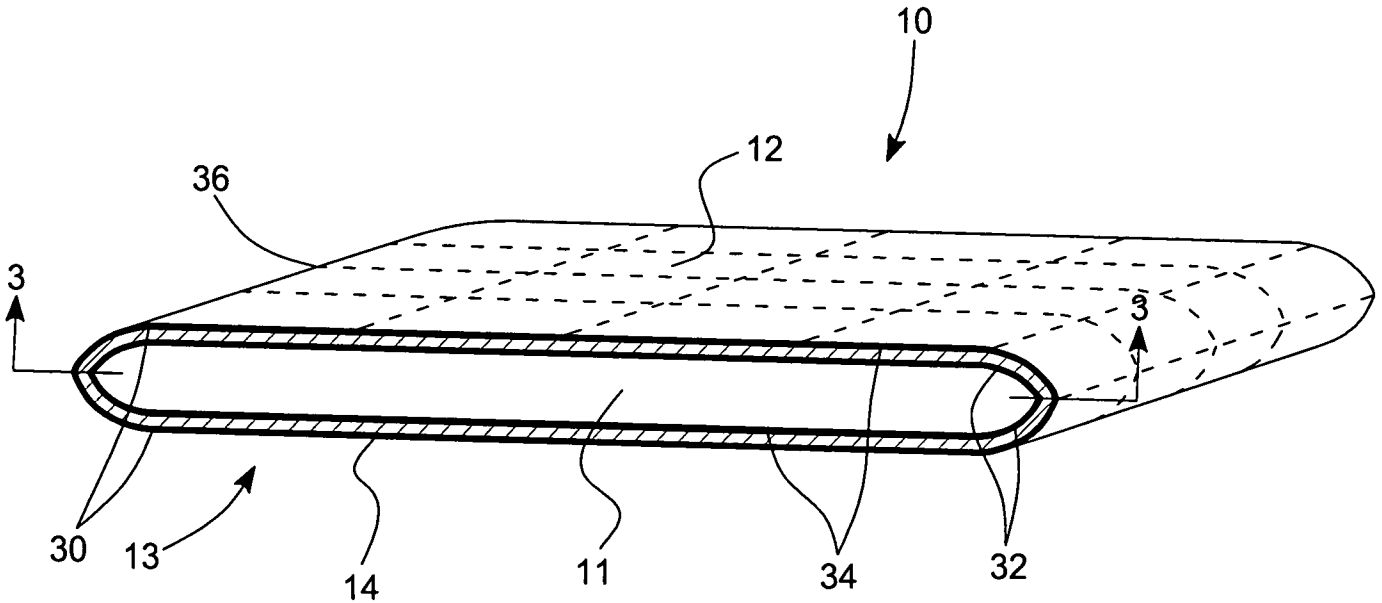
FIG. 2 is a cross-sectional view of the cover in FIG. 1 taken along line 2-2 of FIG. 1.
Figure 3:
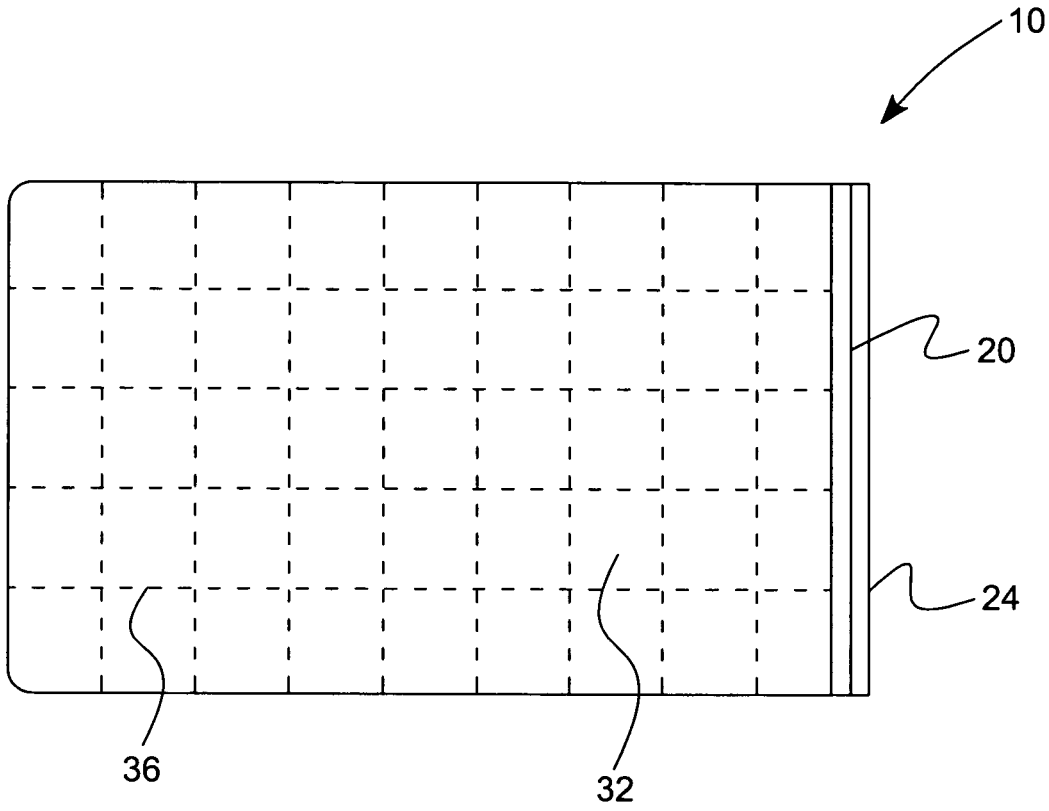
FIG. 3 is a cross-sectional view of the cover in FIG. 1 taken along line 3-3 of FIG. 2.
Figure 4:
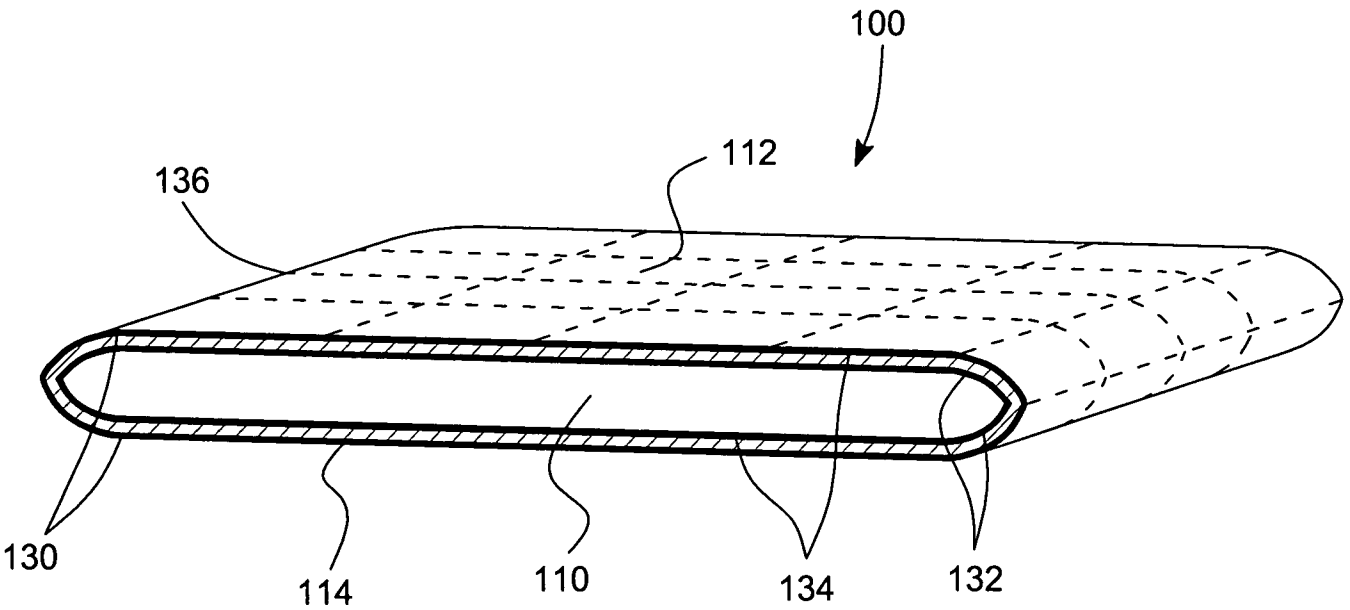
FIG. 4 is a cross-sectional view of a pillow in accordance with another embodiment of the present invention.

With reference to FIG. 4, which shows a similar view to FIG. 2, a pillow 100 is illustrated which comprises a soft, pliable core 110, surrounded by two panels 112 and 114. As with the cover 10 described hereinabove, each panel 114 and 116 comprises a non-woven, breathable inner liner 132 surrounding the core 110, a breathable outer shell 130 and a silk floss lining 134 retained therebetween. In this embodiment, however, there is no need for an opening or corresponding closure.

The properties, and in particular the densities, of these layers 130, 132 and 134 is preferably equivalent to those discussed above with regard to the equivalent layers 30, 32 and 34. Similarly, the pillow 100 is also preferably quilted with stitches 136.

As being now better appreciated, the present invention is an improvement and presents several advantages over other related devices and/or methods known in the prior art.

Of course, numerous modifications could be made to the above-described embodiment without departing from the scope of the invention, as apparent to a person skilled in the art.

The invention claimed is:

1. A cover for a pillow comprising:

a) a hollow body for receiving the pillow, the hollow body comprising:

i. a breathable polypropylene inner liner made of a non-woven material;

ii. a woven breathable outer shell surrounding the inner liner; and iii. a silk floss lining retained between the inner liner and the outer shell, the silk floss lining having a weight between about 80 and about 130 grams per square meter (gsm);

b) an opening for allowing insertion of the pillow into the hollow body; and c) a closure spanning the opening for closing the pillow within the hollow body.

2. The cover of claim 1, wherein the silk floss lining has a weight of about 85 gsm.

3. The cover of claim 1, wherein the outer shell is composed of a woven cotton material.

4. The cover of claim 3, wherein the outer shell is a 223 count cotton.

5. The cover of claim 1, wherein the inner liner has a weight greater than about 40 gsm.

6. The cover of claim 5, wherein the inner liner has a weight of at least about 55 gsm.

7. The cover of claim 1, wherein the closure is a zipper.

8. The cover of claim 1, wherein the inner liner, the silk floss lining and the outer shell are quilted.

9. The cover of claim 8, wherein the quilting comprises a linear grid.

10. The cover of claim 1, wherein the hollow body is formed by two opposing panels each comprising a peripheral edge, the panels being connected around their peripheral edges, the closure spanning a portion of the peripheral edges.

11. A pillow comprising:

a) a core;

b) a breathable polypropylene inner liner, the inner liner being composed of a non-woven material;

c) a woven breathable outer shell surrounding the inner liner and the core; and d) a silk floss lining retained between the inner liner and the outer shell, the silk floss lining having a weight between about 80 and about 130 gsm.

12. The pillow of claim 11, wherein the silk floss lining has a weight of about 85 gsm.

13. The pillow of claim 11, wherein the outer shell is a 223 count woven cotton material.

14. The pillow of claim 11, wherein the inner liner has a weight of about 55 gsm.

* * * * *